US010221551B2

(12) United States Patent
Gray

(10) Patent No.: US 10,221,551 B2
(45) Date of Patent: Mar. 5, 2019

(54) PRESSURE PLUNGER AND ASSOCIATED METHODS

(71) Applicant: William Scott Gray, Poulsbo, WA (US)

(72) Inventor: William Scott Gray, Poulsbo, WA (US)

( * ) Notice: Subject to any disclaimer, the term of this patent is extended or adjusted under 35 U.S.C. 154(b) by 0 days.

(21) Appl. No.: 15/530,857

(22) Filed: Mar. 10, 2017

(65) Prior Publication Data

US 2017/0191250 A1 Jul. 6, 2017

Related U.S. Application Data

(63) Continuation-in-part of application No. 14/491,861, filed on Sep. 19, 2014, now abandoned.

(51) Int. Cl.
*E03C 1/308* (2006.01)
*E03D 9/00* (2006.01)

(52) U.S. Cl.
CPC ..... *E03C 1/308* (2013.01); *E03D 9/00* (2013.01)

(58) Field of Classification Search
CPC ..... E03C 1/308
See application file for complete search history.

(56) References Cited

U.S. PATENT DOCUMENTS 4,186,451 A * 2/1980 Ruo ..... E03C 1/308 4/255.02
7,340,783 B2 * 3/2008 Leaphart, Jr. ..... E03C 1/308 4/255.02

* cited by examiner

*Primary Examiner* — Janie Loeppke

(57) ABSTRACT

A pressure plunger which consists of a hollow lower tube inserted into a clogged toilet or drain causing no significant displacement of fluid. After the lower tube's compressible end is fixedly attached to a fluid channel, the actuator cylinder may be inserted into the lower tube to create pressure downward and upward to remove blockage. Unlike other designs this plunger consists of two separate sections, each integrally formed, which function together without assembly or disassembly. Vents near the top of the lower tube allow in air to release vacuum pressure when pulling near the top of the lower tube prohibiting fluid being pulled to the top of the lower tube. The lack of assembly and disassembly is also significantly different regarding cleaning and sanitizing. The upper actuator tube can be pulled out and cleaned on the outside and the lower tube can be easily cleaned from either end.

10 Claims, 2 Drawing Sheets

PRESSURE PLUNGER AND ASSOCIATED METHODS

TECHNICAL FIELD

The disclosed embodiments relate to, and claim priority over, Parent application Ser. No. 14/491,861 of a pressure plunger for clearing clogs from a fluid channel. In particular, the present technology relates to a significant difference in the amount of fluid displaced when inserting the plunger into fluid with no assembly or disassembly required for use or for sanitizing.

BACKGROUND (Currently Amended) Fluid channels can become clogged by cumulated materials or particles suspended in fluids flowing through fluid channels. Clogs are dislodged by generating pressure in the fluids against the obstruction, pushing it through, or by creating suction which pulls the materials back enabling them to rearrange separate and flow through the channel. When inserting a bulbous plunger or an assembled cylindrical plunger into the fluid a large volume of fluid is displaced. This can potentially cause an unsanitary overflow. A pressure plunger which may be used by first inserting a hollow tube through the fluid and does not displace the volume of water taken up by the volume of the cylinder eliminates any significant risk of fluid overflow. The upper tube cylinder is then inserted without assembling to create the pressure against or away from the obstruction to remove the clog. It is advantageous to have an improved pressure plunger that does not cause potential overflow. It is also advantageous that the plunger is comprised of only 2 individual parts which function together yet do not require assembly or disassembly and are then easily cleaned and sanitized.

DETAILED DESCRIPTION

Figure 1:
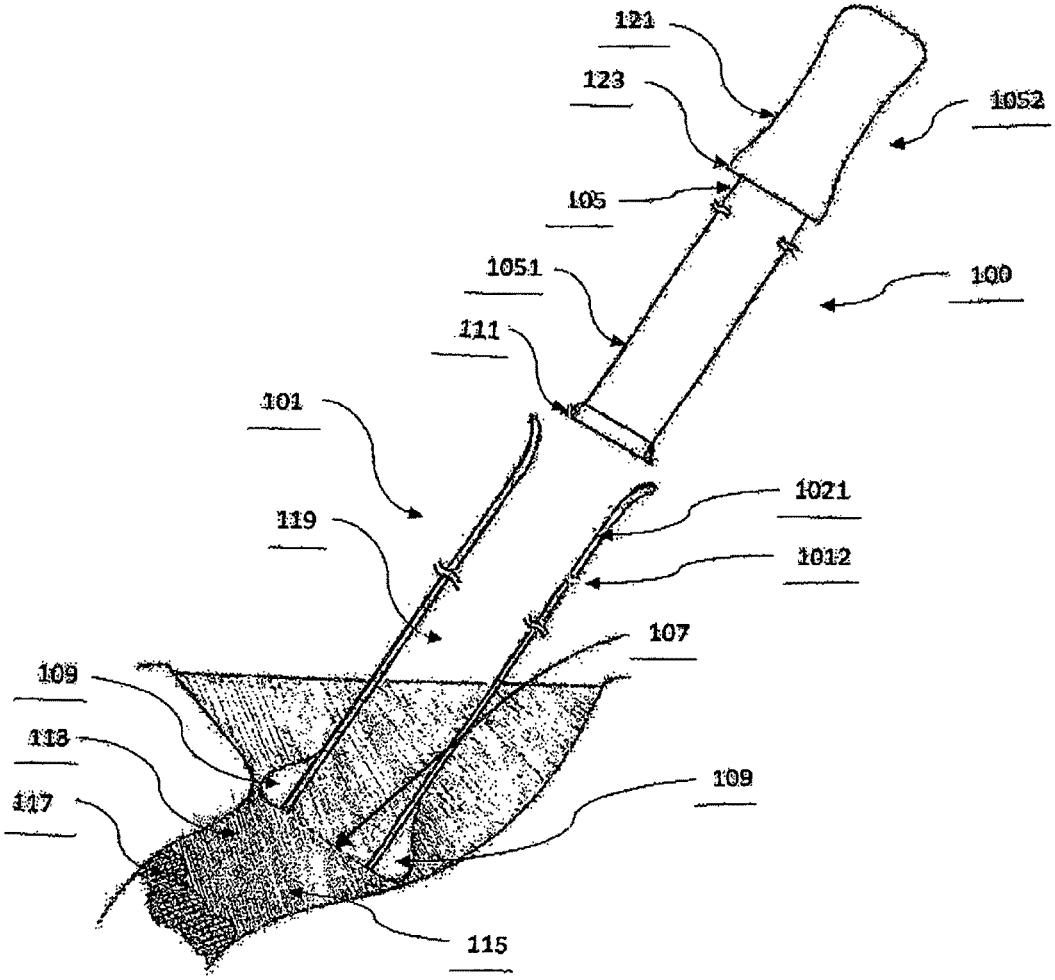
FIG. 1 is a schematic cross-sectional view illustrating a plunger apparatus in accordance with embodiments of the present technology.

Specific details of several embodiments of pressure plungers and associated methods are described below. A person skilled in the relevant art will also understand that the technology may have additional embodiments, and that the technology may be practiced without several of the details of the embodiments described below with reference to FIGS. 1 and 2.

(Currently Amended) A plunger apparatus in accordance with the present technology can be easily used without being assembled and disassembled. The non-assembling-disassembling feature provides at least the benefits of (1) a plunger apparatus in accordance with the present technology that can accommodate fluid therein, thereby avoiding or significantly mitigating possible fluid displacement and or overflow and (2) enabling a user to easily maintain or clean the pressure plunger. Several embodiments of pressure plungers in accordance with the present technology can include an outer tube that defines a chamber, an actuator (e.g., a cylinder) which can be positioned inside the outer tube, a seal (e.g., a seal ring or molded seal) positioned between the outer tube and the actuator, and a flexible compressible fitting which is part of the outer tube. In some embodiments, the fitting and the outer tube can be integrally formed together, such as by a molding process. A user can operate the pressure plunger by moving (e.g., pushing and/or pulling) the actuator so as to generate positive and/or negative pressure differences that dislodge clogs from a fluid channel (e.g., in a toilet or a drain).

The seal can be operably (e.g., movably) attached to an inner surface of the outer tube and fixedly (e.g., non-movably) attached to an outer surface of the actuator. During operation when the pressure plunger is inserted into a clogged fluid channel, the seal can create an air-tight chamber inside the chamber defined by the outer tube. As a user moves (e.g., pushes and/or pulls) the actuator, the seal can move accordingly while maintaining the air-tight condition. The movements of the actuator and the seal can thus generate pressure differences that dislodge a clog in a clogged fluid channel.

In some embodiments, the fitting can be designed to have a flexible compressible end to fit a fluid channel so as to provide a close contact therewith. This arrangement enables a user to easily insert and fit the plunger apparatus into a curved/angled fluid channel or a fluid channel with a narrow opening. In some embodiments, the fitting can have a compressible seal that can engage the perimeter surface of a fluid channel.

(Currently Amended) Methods for mitigating a clogging in a fluid channel are also disclosed. A method may include first positioning the lower part of a plunger apparatus (e.g., an outer tube with a flexible compressible seal at the bottom) into a clogged fluid channel. More particularly, the method can include positioning the fitting attached to the outer tube into the clogged fluid channel. The method may then include inserting the actuator cylinder into the top of the lower tube to operably attach the gasket end with the inner surface of the lower tube which is connected to the clogged fluid channel. The method can then move (e.g., push) the actuator positioned inside the outer tube in a first direction (e.g., a direction towards the clogged fluid channel) over a first distance (e.g., along a portion of the length of the outer tube) so as to generate a first pressure in the clogged fluid channel. The method can further include moving (e.g., pull) the actuator in a second direction (e.g., opposite to the first direction) over a second distance so as to generate a second pressure difference in the clogged fluid channel. The method can repeatedly move the actuator so as to generate proper pressure differences until a clog is dislodged from the clogged fluid channel. If the user pulls the actuator near the top of the lower cylinder the seal will go beyond the vent holes which will allow in ambient air to break vacuum and not allow fluid to be pulled to the top of the lower tube and potentially create unsanitary spillage.

FIG. 1 is a schematic cross-sectional view illustrating a plunger apparatus 100 in accordance with embodiments of the present technology. As shown in FIG. 1, the plunger apparatus 100 includes an outer tube 101, an actuator 105 which can be positioned inside the outer tube 101, and a seal 111.

In some embodiments, the lower outer tube 101 and the actuator 105 can each be integrally formed into one piece using a variety of materials. In the illustrated embodiment, the opening 107 can include a flexible compressible seal 109. In some embodiments, the flexible compressible seal 109 can be made of flexible compressible materials (e.g.

silicone or other suitable materials). In other embodiments, the seal 109 can have different shapes for fitting different types of fluid channels.

As shown in FIG. 1, the lower tube 101 can be positioned to connect the lower seal to the opening of the fluid channel. The seal 111 can be positioned between the outer tube 101 and the actuator 105. The seal 111 is operably (e.g., movably) attached to an inner surface of the outer tube 101 and an integral part of the outer surface 1051 of the actuator 105. When a user positions the plunger apparatus 100 into a fluid channel 113 (having a fluid 115 and at least one clog 117 therein), the seal 111 can create a substantive air-tight chamber 119 inside the outer tube 101. When a user moves (e.g., pushes or pulls) the actuator 105 upwardly or downwardly (e.g., along the vertical axis of FIG. 1), the seal 111 can be moved accordingly to maintain the substantive air-tight chamber 119. The movements of the actuator 105 and the seal 111 can generate positive and negative pressure differences of the fluid 115 (e.g., the actuator 105 compresses the air in the substantive air-tight chamber 119 and the compressed air then further compresses the fluid 115) so as to dislodge the clog 117 in the fluid channel 113 (e.g., the clog 117 starts to flow with the fluid 115 in the fluid channel 113). In other embodiments, the substantive air-tight chamber 119 can be filled with the fluid 115. In this case, the movement of the actuator 105 and the seal 111 can generate a pressure difference of the fluid 115 by directly compressing the fluid 115.

The actuator 105 can include a cap 1052. When the cap 1052 contacts the outer tube 101, the actuator 105 stops moving downwardly (e.g., along the vertical axis of FIG. 1). In the illustrated embodiment, the cap 1052 can include a handle with a recess 121 and, and the lower hollow outer tube 101 includes a recess 1021. The handle 1052 and the recess 121 and the recess 1021 can facilitate a user to grasp the actuator 105 during operation. The stop 123 can be configured to stop the downward movement of the actuator 105. In some embodiments, the stop 123 can be made of hard plastic material (e.g., PVC). In some embodiments, the stop 123 and the cap 1052 can be integrally formed. In some embodiments, the cap 1052 can have different shapes depending on various designs.

As shown in FIG. 1, the outer tube 101 can include a vent (e.g., a ventilation hole or inner grooves at the top of tube 101) 1012. The vent 1012 is configured to enable ambient air to flow into or out of the outer tube 101 when the actuator 105 is removed or inserted. For example, when the seal 111 moves (e.g., upwardly) over the vent 1012, ambient air can flow into the outer tube 101 via the vent 1012 thereby breaking vacuum of upward pressure so as to prevent the fluid 115 from moving up and reaching the top of the outer tube 101.

Figure 2:
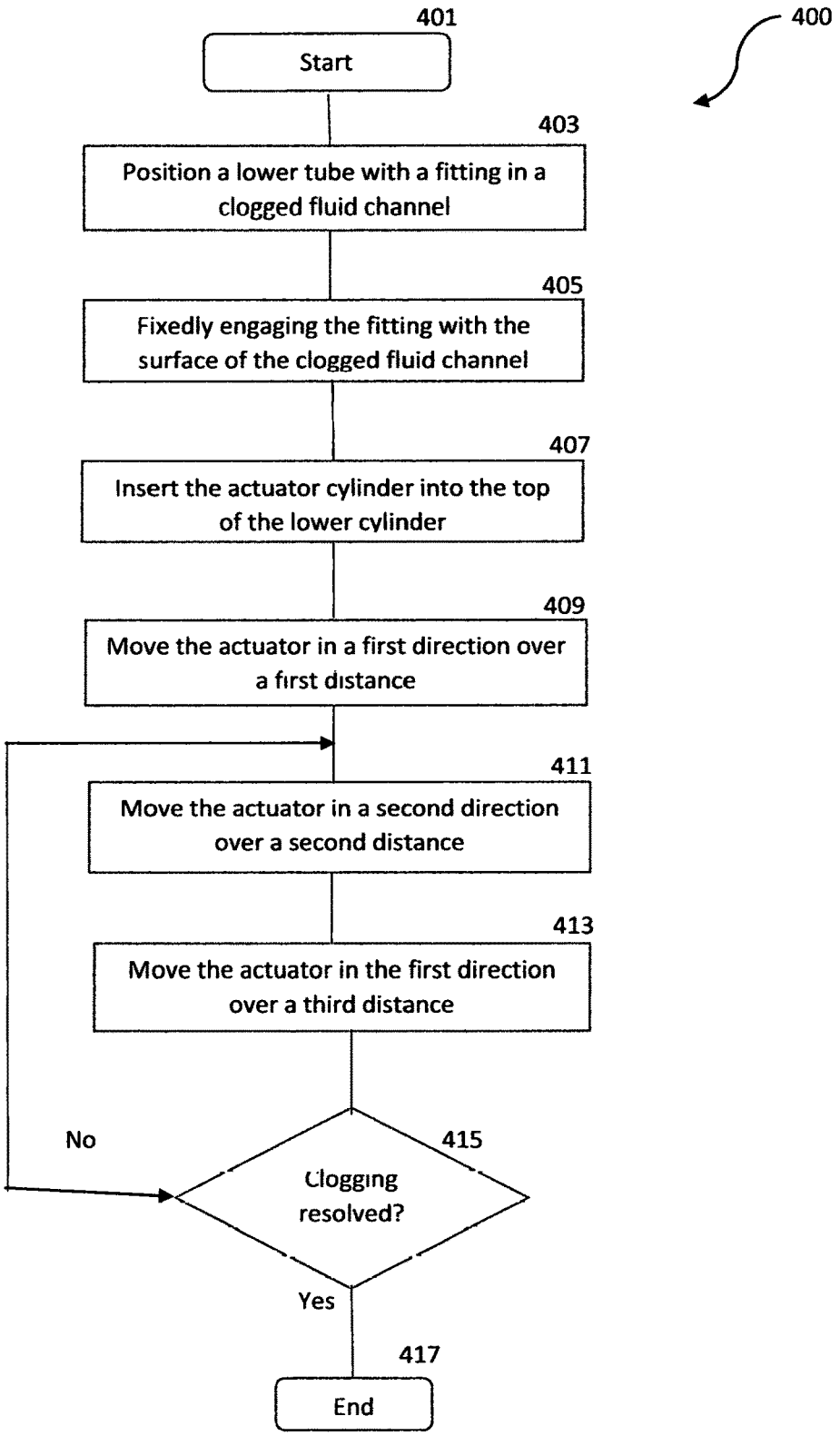
FIG. 2 is a flowchart illustrating a method in accordance with embodiments of the present technology.

FIG. 2 is a flowchart illustrating a method 400 in accordance with embodiments of the present technology. The method 400 illustrates an operation of a plunger apparatus. The plunger apparatus can include an outer tube, a fitting coupled to the outer tube, an actuator positioned inside the outer tube, and a seal. The method 400 starts at block 401 and then continues at block 403 by positioning the fitting of the lower tube in a clogged fluid channel. The method 400 continues at block 405 by fixedly engaging the fitting with a surface of the clogged fluid channel. In some embodiments, the method 400 can include deforming a flexible compressible seal (e.g. 109 of the fitting) when creating a connection between lower outer chamber 101 and the surface of the clogged fluid channel.

At block 407, the method 400 continues by inserting the upper actuator cylinder into the opening of the top of the lower cylinder. At block 409, the method 400 continues by moving (e.g., pushing) the actuator positioned inside the outer tube in a first direction (e.g., downwardly along the vertical direction) over a first distance so as to generate a first pressure difference in the clogged fluid channel. The method continues at block 411 by moving (e.g., pulling) the actuator in a second direction opposite to the first direction (e.g., upwardly along the vertical direction) over a second distance so as to generate a second pressure difference in the clogged fluid channel. At block 413, the method 400 continues by moving (e.g., pushing) the actuator in the first direction (e.g., downwardly along the vertical direction) over a third distance so as to generate a third pressure difference in the clogged fluid channel.

The method 400 then proceeds to a decision at block 415 to determine whether a clog in the fluid channel has been resolved. If so, then the method 400 ends at block 417. If not the method can return to block 411, depending on conditions, to repeat the movements of the actuator described in blocks 411 and 413 until the clogging is resolved.

From the foregoing, it will be appreciated that specific embodiments of the technology have been described herein for purposes of illustration, but that various modifications may be made without deviating from the disclosure. Certain aspects of the new technology described in the context of particular embodiments may also be combined or eliminated in other embodiments. Moreover, although advantages associated with certain embodiments of the new technology have been described in the context of those embodiments, other embodiments may also exhibit such advantages and not all embodiments need necessarily exhibit such advantages to fall within the scope of the technology. Accordingly, the disclosure and associated technology can encompass other embodiments not expressly shown or described herein.

I claim:

1. A plunger apparatus comprising two separate sections: a first section comprising a lower hollow outer tube and chamber wherein said lower hollow outer tube is placed to make a connection in a clogged fluid channel, wherein the plunger is sized and shaped to displace a minimal volume of fluid when inserted into the clogged fluid channel: and a second section comprising an actuator section, wherein said actuator section is placed into the lower outer tube and moved reciprocally to generate pressure to draw and/or eject fluid and dislodge an obstruction.

2. The plunger apparatus according to claim 1, wherein the lower hollow outer tube further comprises an integral flexible compressible seal at a first end of the lower hollow outer tube and venting holes at a second end of the lower hollow outer tube, and the actuator section further comprises an second integral seal at a first end of the actuator section and an integral cap at a second end of the actuator section.

3. The plunger apparatus according to claim 2, wherein the cap is configured to stop movement of the actuator section with respect to the lower hollow outer tube in a first direction.

4. The plunger apparatus according to claim 2, wherein the lower hollow outer tube and the actuator section further comprise a recess facilitating a user to grasp the two separate sections during operation.

5. The plunger apparatus according to claim 2, wherein the integral flexible compressible seal is a compressible fitting configured to make contact with a surface of the fluid channel.

6. The plunger apparatus according to claim 2, wherein the venting holes allow air to enter and release a vacuum during upward movement of the actuator section when the actuator section approaches a top opening of the lower hollow outer tube.

7. The plunger apparatus according to claim 1, wherein the actuator section further comprises a cap configured to stop movement of the actuator section with respect to the lower hollow outer tube in a first direction.

8. The plunger apparatus according to claim 1, wherein the lower hollow outer tube and the actuator section further comprise a recess facilitating a user to grasp the two separate sections during operation.

9. The plunger apparatus according to claim 1, further comprising a fitting integrally formed with the lower hollow outer tube, wherein the fitting is compressible to make contact with a surface of the fluid channel.

10. The plunger apparatus according to claim 1, wherein the lower hollow outer tube further comprises a vent for allowing air to enter and for releasing a vacuum during upward movement of the actuator section when the actuator section approaches a top opening of the lower hollow outer tube.

* * * * *